US005941761A

United States Patent [19]

Nagahara et al.

[11] Patent Number: 5,941,761

[45] Date of Patent: Aug. 24, 1999

[54] SHAPING POLISHING PAD TO CONTROL MATERIAL REMOVAL RATE SELECTIVELY

[75] Inventors: Ronald J. Nagahara, San Jose; Dawn M. Lee, Morgan Hill, both of Calif.

[73] Assignee: LSI Logic Corporation, Milpitas, Calif.

[21] Appl. No.: 08/921,758

[22] Filed: Aug. 25, 1997

[51] Int. Cl.[6] ..... B24B 53/00

[52] U.S. Cl. ..... 451/56; 451/444; 451/461

[58] Field of Search ..... 451/56, 72, 443, 451/444, 41, 461, 287, 288

[56] References Cited

U.S. PATENT DOCUMENTS 5,081,051 1/1992 Mattingly et al. .
5,216,843 6/1993 Breivogel et al. .
5,456,630 10/1995 Kaiser et al. ..... 451/443
5,536,202 7/1996 Appel et al. .
5,547,417 8/1996 Breivogel et al. .
5,605,499 2/1997 Sugiyama et al. ..... 451/41

*Primary Examiner*—Robert A. Rose
*Attorney, Agent, or Firm*—Beyer & Weaver, LLP

[57] ABSTRACT

An end effector to facilitate conditioning of a surface of a polishing pad used in chemical-mechanical polishing of an substrate surface is described. The end effector includes a rigid body including a contact surface capable of being attached to a conditioning disk and having a predetermined non-planar region that is adapted to at least one of (i) effectively maintain a non-planar area on the surface of the polishing pad and (ii) shape the polishing pad, when the end effector is employed to condition the polishing pad.

32 Claims, 6 Drawing Sheets

SHAPING POLISHING PAD TO CONTROL MATERIAL REMOVAL RATE SELECTIVELY

BACKGROUND OF THE INVENTION

The present invention relates to conditioning sub-assemblies for conditioning a polishing pad (hereinafter referred to as "pad conditioning") that is employed in chemical-mechanical polishing (sometimes referred to as "CMP") of substrates. More particularly, the present invention relates to conditioning sub-assemblies including conditioning surfaces that have predetermined non-planar regions to effectively (1) maintain an existing polishing pad shape and/or (2) shape the polishing pad during pad conditioning.

As is well known in the art, an end effector and a conditioning disk are integral components in a conditioning sub-assembly that is typically employed during pad conditioning. Chemical-mechanical polishing (CMP) typically involves mounting a substrate, such as a semiconductor wafer, faced down on a holder and rotating the wafer face against a polishing pad mounted on a platen, which in turn rotates or orbits about an axis. A slurry containing a chemical that chemically interacts with the facing wafer layer and an abrasive that physically removes that layer is flowed between the wafer and the polishing pad or on the pad near the wafer. In semiconductor wafer fabrication, this technique is commonly applied to planarize various wafer layers such as dieletric layers, metallization layers, etc.

After polishing a significant number of wafers on the same polishing pad, the part of the polishing pad that contacts a center region of the wafer deteriorates to a greater extent than other regions of the polishing pad. This deterioration is attributed primarily to a constant down force applied by the wafer during CMP. As a result, well before the end of a production lot draws near, the wafers subjected to CMP experience a slower film removal rate at the center region of the wafer relative to the edge or peripheral regions of the wafer surface, which phenomenon is known in the art as "center slow polishing." "Production lot" refers to a collection of wafers that are fabricated as a group under substantially similar conditions and may ultimately be sold. Center slow polishing is undesirable because it leads to a non-uniformly polished wafer surface, i.e. the center region of the wafer surface is not polished to the same extent as the peripheral region of the wafer. This prematurely ends the life of the polishing pad. In a typical wafer fabrication facility, where several CMP apparatus are employed, the replacement cost of polishing pads can be significant.

One approach currently adopted to combat the non-uniformity produced by center slow polishing involves producing "center fast polishing" conditions by shaping the polishing pad appropriately. As used herein, "center fast polishing" refers to a situation where the wafer experiences a faster film removal rate at the center region of the wafer surface relative to the peripheral region of the wafer surface. In this approach, the polishing pad is initially shaped to produce center fast polishing within the limits of uniformity, i.e. the resulting wafer may have an overpolished center region, but the degree of center to edge non-uniformity is not unacceptably high. The center fast polishing conditions advanced at the beginning of the polishing pad life, therefore, effectively counteract the eventual center slow polishing conditions produced by the worn-out polishing pad.

Before a first wafer from a production lot is subjected to CMP, the polishing pad undergoes preconditioning (hereinafter referred to as "pad preconditioning") at which time the pad is broken-in typically by polishing dummy wafers on the polishing pad. FIG. 1A shows a cross-sectional view of a typical preconditioned polishing pad 10 shaped appropriately to produce center fast polishing conditions. The cross-sectional view of the polishing pad 10 shows two protruding domes 12, which are part of a circular protruding dome shaped wafer track, as shown in a top view of FIG. 1B. Polishing pad 10 includes a circular protruding dome shaped area 12 that is located between the center and peripheral regions of the polishing pad. FIG. 1B also shows a top view of a rotating preconditioned polishing pad 10 with a rotating wafer 16 that carves out a wafer track, which includes an inner boundary 18, an outer boundary 20 between which resides circular protruding dome shaped area 12 formed during pad preconditioning. Those skilled in the art will recognize that the width of the wafer track may be larger than the diameter of the wafer because during CMP, the rotating wafer also oscillates from side to side in a radial direction of the polishing pad. A wafer undergoing CMP on the protruding dome shaped wafer track has a larger polishing pad area available to polish the center region as opposed to the peripheral region of the wafer and will therefore experience center fast polishing. Furthermore, any down force applied on the wafer during CMP will have a greater impact at the center region of the wafer as it contacts the thickest portion of the protruding wafer track.

In order to achieve and maintain a high and stable polishing rate, the polishing pad undergoes conditioning on a regular basis, i.e. either every time after a wafer has been polished or simultaneously during wafer CMP. During pad conditioning, the polishing pad is abraded to form grooves, which facilitate slurry flow across the polishing pad and to the pad-wafer interface. FIG. 1B shows an end effector 22 of a representative conventional pad conditioning sub-assembly that contacts a polishing pad surface during pad conditioning. For simplifying illustration, end effector 22 and its movement from the center to edge on the polishing pad, during pad conditioning, are shown below polishing pad 10'. End effector 22 is typically cylindrically shaped and has two planar surfaces, one of which is designed to secure a conditioning disk (not shown to simplify illustration) that is also cylindrically shaped and has planar surfaces. The other planar surface of the conditioning disk is an abrasive surface that faces a polishing pad surface and abrades the pad surface during pad conditioning. The conventional pad conditioning sub-assembly, including end effector 22 and the conditioning disk, is attached to a pivoting conditioning arm (not shown to simplify illustration).

Before the conventional pad conditioning sub-assembly begins conditioning, end effector 22 is lowered automatically so that the abrasive surface of the conditioning disk may contact polishing pad 10, which may be rotating or orbiting. A pneumatic cylinder (not shown to simplify illustration) may then apply a downward force on end effector 22 such that the abrasive particles engage polishing pad 10 as the conditioning disk along with the end effector move on the polishing pad surface. For example, in the CMP apparatus such as Avanti 472, commercially available from Integrated Processing Equipment Corporation (IPEC) of Phoenix, Ariz. during pad conditioning, end effector 22 may slide along a length of the stationary conditioning arm in a radial direction from typically the center to the edge. As another example, in the CMP apparatus of Strasbaugh 6DS-JP, commercially available from Strasbaugh of San Luis Obispo, Calif. an end effector is attached to a conditioning arm, which moves in a radial direction of the polishing pad from an inner to an outer region of the polishing pad.

The software currently employed to automatically implement pad conditioning divides the distance from the edge to center of polishing pad 10 into various segments 26 of equal length, as shown in FIG. 1B. During pad conditioning, the conditioning disk moves from one segment to the next based on a conditioning recipe that is designed to maintain the shape of the polishing pad. The conditioning recipe assigns a predetermined "dwell time" and a predetermined polishing pad rotation rate for each segment. The term "dwell time" is well known in the art and refers to a period of time that the conditioning disk dwells or remains in contact with a particular area or segment of the polishing pad. In other words, during pad conditioning, the conditioning disk will contact a particular segment of the polishing pad for a predetermined duration, while the polishing pad rotates at a certain speed typically measured in rotations per minute (rpm). Conventional pad conditioning processes attempt to maintain the shape of the polishing pad by implementing an appropriate conditioning recipe, which may have varying dwell times and the polishing pad rotation rates from one segment to another. By way of example, in those segments where the protruding dome shaped area is to be maintained, the dwell time for the same polishing pad rotation rate may be shorter relative to other regions of the polishing pad that are substantially planar.

Unfortunately, the current pad conditioning process fails to effectively control or maintain the shape of the polishing pad to produce the desired center fast polishing conditions. By way of example, the segmented movement of the end effector in a radial direction of the polishing pad makes it very difficult to control the degree of protrusion of the dome shaped area on the polishing pad. As the end effector moves from its first position 22 at one segment to its second position 22' at a second segment, for example, it dwells on an overlap region 24 (shown as a shaded region in FIG. 1B based on two different dwell times, i.e. the conditioning disk contacts the overlapping region for a first dwell time associated with a first segment and then contacts the overlapping region again for a second dwell time associated with a second segment. Overlap region 24 is formed because the end effector, which typically has a diameter between about 4 and about 6 inches, dwells on segments that are typically shorter than the diameter of the end effector. Consequently, such overlap regions on the polishing pad make it difficult to control the degree of protrusion of the dome shaped wafer track. Furthermore, the segmented movement of the end effector is time consuming, which translates into a low throughput for the CMP process.

As another example, after pad life of a polishing pad from an initial pad lot has concluded, a new polishing pad may be employed from a subsequent pad lot, which may have a different hardness than the initial pad lot due to different processing conditions employed during polishing pad manufacturing. As a result, the appropriate conditioning recipe implemented in conditioning the old polishing pad from the initial pad lot may no longer be effective to maintain the shape of the new polishing pad. Those skilled in the art will recognize that under such circumstances, it may be necessary to determine a new pad conditioning recipe that effictively shapes the new polishing pad. This typically requires testing the polishing pad of the new pad lot and is therefore a time-consuming and an arduous task, which lowers wafer throughput.

What is therefore needed is an improved pad conditioning apparatus and process that effectively controls, maintains the polishing pad shape and is not time consuming.

SUMMARY OF THE INVENTION

To achieve the foregoing, the present invention provides an end effector to facilitate conditioning of a surface of a polishing pad used in chemical-mechanical polishing of an substrate surface. The end effector includes a rigid body including a contact surface capable of being attached to a conditioning disk and having a predetermined non-planar region that is adapted to at least one of (i) effectively maintain a non-planar area on the surface of the polishing pad and (ii) shape the polishing pad, when the end effector is employed to condition the polishing pad. The predetermined non-planar region of the end effector may generally have a depth that is between about 2 and 20 mils, preferably have a depth that is between about 2 and 10 mils.

According to one embodiment of the present invention, the predetermined non-planar region of the end effector includes in a substantially planar region of the contact surface a concave region recessed inwardly into the contact surface of the end effector and extending across the substantially planar region in a curved profile defined by an inner boundary and outer boundary of the concave region such that shape of the concave region facilitates maintaining a circular protruding dome shaped area on the polishing pad when the end effector is employed to condition the polishing pad. A conditioning sub-assembly, according to one embodiment of the present invention, includes the end effector described above and a conditioning disk of a substantially uniform predetermined thickness including a conditioning surface having abrasive means adapted to engage the polishing pad and a second surface adhering to the contact surface of the end effector and thereby shaping the conditioning surface of the conditioning disk to include in a substantially planar conditioning region a concave conditioning region that almost conforms to a portion of the circular protruding dome shaped area on the polishing pad during conditioning of the polishing pad.

In this conditioning sub-assembly, the abrasive means may be a tape adhering to at least a concave conditioning region of the conditioning surface on one side and impregnated with abrasive particles on a second side, which abrasive particles engage the protruding dome shaped area of the polishing pad during conditioning of the polishing pad to form microgrooves thereon. The abrasive means may also include blades disposed at least on a substantially planar conditioning region of the conditioning surface, which substantially planar conditioning region excludes the concave conditioning region of the conditioning surface and the blades adapted to scive the polishing pad and thereby effectively erode at least a portion of the polishing pad around the protruding dome shaped area.

In this conditioning sub-assembly, the inner boundary and outer boundaries of the concave region may be separated by a distance that is between about 6 inches and about 14 inches. The outer boundary of the concave region may have a radius of curvature that may be between about 7 and about 13 inches. The concave region may recess inwardly into the contact surface of the end effector by a maximum distance of between about 2 and about 20 mils. The predetermined thickness of the conditioning disk may be between about 0.1 and about 0.25 inches.

In another aspect of the present invention, the predetermined non-planar region of the contact surface of the end effector includes a first substantially planar portion that protrudes outwardly, relative to a second substantially planar portion, from the contact surface and the contact surface during conditioning of the polishing pad facilitates formation of one substantially planar area that recesses inwardly, relative to a second substantially planar area, into the polishing pad surface. A conditioning sub-assembly, according to another embodiment of the present invention, includes the end effector mentioned above and a conditioning disk of substantially uniform predetermined thickness including a conditioning surface having abrasive means adapted to engage the polishing pad and a second surface adhering to the contact surface of the end effector and thereby shaping the conditioning surface of the conditioning disk to include a first substantially planar conditioning region that protrudes outwardly relative to a second substantially planar conditioning region and from the conditioning surface such that during conditioning of the polishing pad the conditioning surface effectively forms one substantially planar area that recesses inwardly relative to a second substantially planar area and into the polishing pad surface.

In this conditioning sub-assembly, the abrasive means may be a tape adhering to a second substantially planar conditioning region of the conditioning surface on one side and impregnated with abrasive particles on a second side, the abrasive particles engage the second substantially planar area of the polishing pad during conditioning of the polishing pad to form microgrooves thereon. The abrasive means may also include blades disposed on at least the first substantially planar conditioning region of the conditioning surface and the blades effectively scive the polishing pad surface during conditioning of the polishing pad to effectively erode at least a portion of the of the polishing pad surface and form thereon the first substantially planar area adjacent to a second substantially planar area.

The second substantially planar portion may have a length that is between about 0.5 inches and about 20 inches and the first substantially planar portion has a length that is between about 0.5 inches and about 5 inches. The conditioning sub-assembly may further include a third substantially planar portion that protrudes from the contact surface more than the second substantially planar portion and nearly to same extent as the first substantially planar portion. A distance between the third and first substantially planar portions may be between about 0.5 and about 11 inches. The first substantially planar portion may protrude relative to second planar portion by a distance of between about 2 and about 20 mils.

In yet another aspect, the present invention provides the conditioning disk comprises a rigid body including a conditioning surface having a predetermined non-planar region that is adapted to at least one of effectively maintain a non-planar area on the surface of the polishing pad and shape a polishing pad when the conditioning disk is employed to condition the polishing pad. In one embodiment of the present invention, the predetermined non-planar region of the conditioning disk may include in a substantially planar region of the conditioning surface a concave region recessed inwardly into the conditioning surface of the conditioning disk and extending across the substantially planar region in a curved profile defined by an inner boundary and outer boundary of the concave region such that a shape of the concave region almost conforms to at least a portion of and maintains the circular protruding dome shaped area on the polishing pad when the conditioning disk is employed to condition the polishing pad.

A conditioning sub-assembly, according to one embodiment of the present invention, includes an end effector having a substantially planar contact surface that is adapted to attach to a conditioning disk, and a conditioning disk mentioned above that includes another surface adhering to the substantially planar contact surface of the end effector and the conditioning surface includes abrasive means adapted to engage the polishing pad. In this conditioning sub-assembly, the abrasive means may be a tape adhering to at least the concave region of the conditioning surface of the conditioning disk on one side and impregnated with abrasive particles on a second side, the abrasive particles engage the protruding dome shaped area of the polishing pad during conditioning of the polishing pad to form microgrooves thereon. The abrasive means may include blades disposed at least on the substantially planar region of the conditioning surface of the conditioning disk, the substantially planar region excludes the concave region of the conditioning disk and the blades adapted to scive the polishing pad during the conditioning of the polishing pad and thereby effectively erode at least a portion of the polishing pad around the protruding dome shaped area.

According to another embodiment of the present invention, the predetermined non-planar region of the conditioning surface of the conditioning disk includes a first substantially planar portion that protrudes outwardly relative to a second substantially planar portion from the conditioning surface and during conditioning of the polishing pad the conditioning surface effectively forms one substantially planar area that recesses inward relative to a second substantially planar area into the polishing pad surface. The conditioning sub-assembly, according to another embodiment of the present invention, may include an end effector of substantially planar contact surface that is adapted to attach to a conditioning disk and the conditioning disk includes another surface adhering to the substantially planar contact surface of the end effector, abrasive means adapted to engage the polishing pad.

In this conditioning sub-assembly the abrasive means may be a tape adhering to second substantially planar portion of the conditioning surface on one side and impregnated with abrasive particles on a second side, the abrasive particles engage the second substantially planar area of the polishing pad during conditioning of the polishing pad to form microgrooves thereon. The abrasive means may also include blades disposed on at least the first substantially planar portion of the conditioning surface and the blades effectively scive the polishing pad surface during conditioning of the polishing pad to effectively erode at least a portion of the of the polishing pad surface and form thereon the first substantially planar area adjacent to the second substantially planar area.

In yet another aspect, the present invention provides a process of conditioning a polishing pad used in chemical-mechanical polishing of an substrate. The process includes providing a conditioning sub-assembly including an end effector including a rigid body having a contact surface with a predetermined non-planar region and capable of being attached to a conditioning disk and a conditioning disk of a substantially uniform predetermined thickness including a conditioning surface having abrasive means adapted to engage the polishing pad and the conditioning disk further including another surface adhering to the contact surface of the end effector and thereby shaping the conditioning surface to have in a substantially planar conditioning region a predetermined non-planar conditioning region. The process further includes rotating the polishing pad and applying a down force on the conditioning sub-assembly such that the abrasive means of the conditioning disk engages the surface of the polishing pad and the conditioning sub-assembly at least one of effectively maintains a non-planar area on the surface of the polishing pad by conformally positioning the predetermined non-planar conditioning region on the non-planar area of the polishing pad and shapes the polishing pad to include a non-planar area by sciving a portion of the polishing pad.

In step of applying the down force, the down force is generally between about 1 and about 15 pounds, preferably between about 1 and about 10 pounds, and more preferably between about 1.5 and about 7 pounds.

In yet another aspect, the present invention provides a process of conditioning a polishing pad used in chemical-mechanical polishing of an substrate. The process includes providing a conditioning sub-assembly including an end effector having a substantially planar contact surface that is adapted to attach to a conditioning disk, and the conditioning disk includes a conditioning surface having a non-planar region and abrasive means and the conditioning disk further includes another surface adhering to the substantially planar contact surface of the end effector. The process further includes rotating the polishing pad and applying a down force on the conditioning sub-assembly such that the abrasive means of the conditioning disk engages a surface of the polishing pad and the conditioning sub-assembly at least one of effectively maintains a non-planar area on the surface of the polishing pad by conformally positioning the predetermined non-planar conditioning region of the non-planar area of the polishing pad and shapes the polishing pad to include a non-planar area by sciving a portion of the polishing pad. In the step of applying the down force, the down force is generally between about 1 and about 15 pounds.

The present invention represents a marked improvement over the conventional pad conditioning processes. By way of example, pad conditioning according to the present invention effectively maintains an existing polishing pad shape and/or shapes a polishing pad having a substantially planar surface to have center fast polishing conditions. As mentioned before, maintaining or producing center fast polishing conditions is a viable approach to promote uniform polishing rate as the end of a production lot draws near and thereby prolongs the polishing pad life. This considerably lowers the replacement cost of polishing pads in a substrate fabrication facility.

As another example, the predetermined non-planar regions in a conditioning surface of the conditioning sub-assemblies of the present invention eliminate the need for complicated, time-consuming conditioning recipes and segmented movement of the end effector that are not effective in controlling and maintaining the shape of the polishing pad. This also translates into a higher throughput for the wafer CMP process. Pad conditioning, according to the present invention, requires that relatively minor modifications be made to the conventional pad conditioning sub-assemblies. By way of example, by merely replacing the conventional end effector or conditioning disk with an end effector or conditioning disk of the present invention, all the benefits of the present invention can be realized.

As yet another example, because the non-planar shape of conditioning surface, in the conditioning sub-assemblies of the present invention, can be predetermined to conform to the shape of the polishing pad, it is easy to maintain the polishing pad shape during pad conditioning, regardless of whether the hardness of the pads employed varies from one pad lot to another.

DETAILED DESCRIPTION OF THE PREFERRED EMBODIMENTS

The present invention provides conditioning sub-assemblies including conditioning surfaces that have predetermined non-planar regions to effectively maintain an existing polishing pad shape and/or shape the polishing pad during pad conditioning. In the following description, numerous specific details are set forth in order to fully illustrate a preferred embodiment of the present invention. It will be apparent, however, that the present invention may be practiced without limitation to some specific details presented herein. It should be borne in mind that figures described herein may not be drawn to scale and that the shape of non-planar surfaces, which are shown and described below, may be exaggerated to facilitate a clear understanding of the present invention. Furthermore, the substrates of the present invention may include semiconductor substrates, optical substrates, magnetic media substrates, etc.

In a pad conditioning assembly, according to the present invention, either an end effector or a conditioning disk includes a surface having a predetermined non-planar region. It is important to note that in conventional pad conditioning sub-assemblies, such surfaces of the end effector or conditioning disk are planar. The conditioning sub-assemblies of the present invention are assembled by attaching inventive end effectors to conventional conditioning disks or attaching conventional end effectors to inventive conditioning disks. As will be explained below, pad conditioning sub-assemblies that include the inventive end effectors or conditioning disks effectively condition the polishing pad with non-planar conditioning surfaces.

Figure 1A:
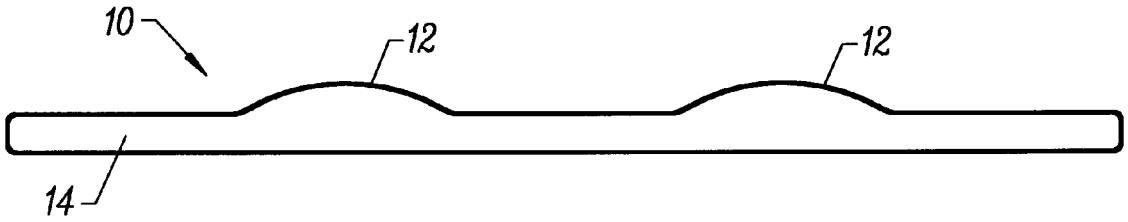
FIG. 1A shows a cross-sectional view of a preconditioned polishing pad appropriately shaped to carry out chemical-mechanical polishing under center fast polishing conditions.
Figure 1B:
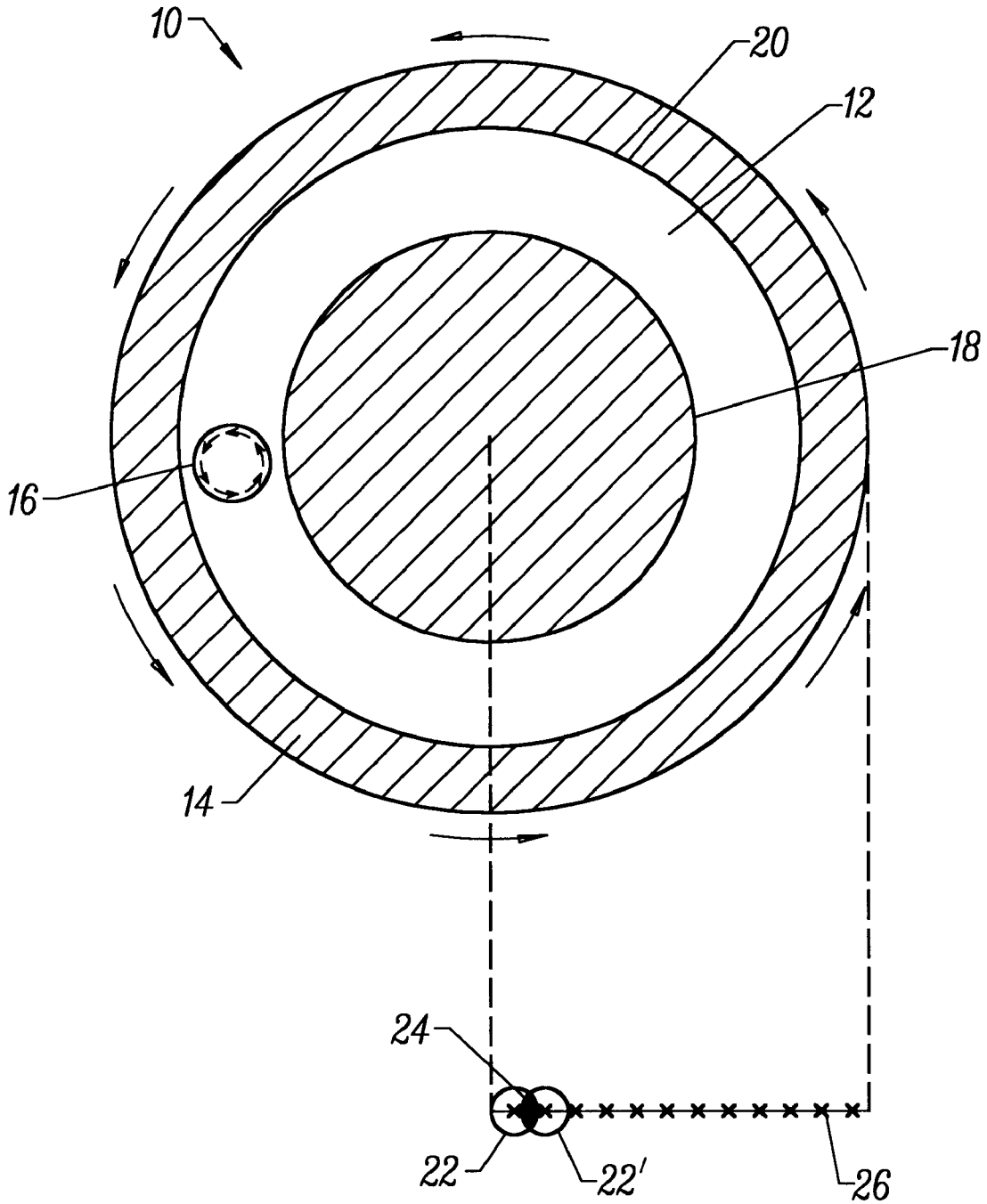
FIG. 1B shows a top view of a polishing pad that is employed for polishing a wafer on a wafer track including a protruding dome shaped area.

The shape and dimensions of the non-planar conditioning surface may be predetermined so that during pad conditioning, the conditioning surface substantially conforms to at least a portion of the non-planar area of the polishing pad. By way of example, a conditioning surface may include a concave region that sufficiently recesses inwardly into the conditioning surface such that the conditioning surface conforms to at least a portion of the protruding dome shaped wafer track shown in FIGS. 1A and 1B.

Additionally the shape and dimensions of the non-planar conditioning surface may be predetermined to effectively shape a substantially planar polishing pad surface during pad conditioning. By way of example, the conditioning surface includes a first substantially planar region protruding outwardly by a predetermined amount relative to a recessed second substantially planar region, such that during pad conditioning the first substantially planar region penetrates the polishing pad and forms thereon the first substantially planar area that ends at the recessed second substantially planar area.

Therefore, during pad conditioning, according to the present invention, the conditioning sub-assembly including the non-planar conditioning surface effectively maintains the existing shape of a non-planar area on a polishing pad and/or forms non-planar areas on a substantially planar polishing pad surface. In this manner, non-planar areas can be maintained or provided on the polishing pad surface to produce center fast polishing conditions, for example. As mentioned above, center fast polishing conditions are known to promote uniform polishing conditions on a wafer surface as the end of a production lot draws near and prolong the life of the polishing pad.

Figure 2A:
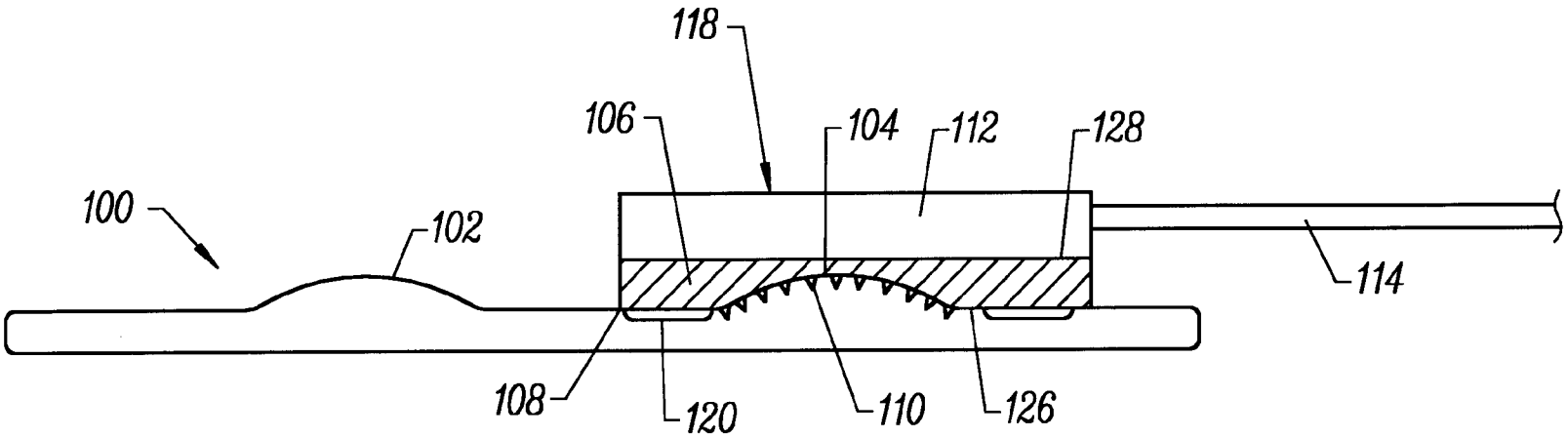
FIG. 2A shows a cross-sectional view of a polishing pad undergoing conditioning by a conditioning sub-assembly, according to one embodiment of the present invention, including an end effector with a substantially planar contact surface, which is attached to a conditioning disk that has a conditioning surface with a concave region that substantially conforms to the circular protruding dome shaped wafer track shown in FIGS. 1A and 1B.

In one embodiment of the present invention, a conditioning surface of a conditioning disk includes a predetermined non-planar region. By way of example, such a conditioning disk is integrated into a conditioning sub-assembly 118 shown in FIG. 2A. FIG. 2A shows a preconditioned polishing pad 100 undergoing conditioning by conditioning sub-assembly 118 that is connected to a conditioning arm 114. Polishing pad 100 is shaped typically during pad preconditioning to have a circular wafer track having a protruding dome shaped area 102 to promote center fast polishing conditions.

It is worth noting that the connection between conditioning arm 114 and conditioning sub-assembly 118 may be realized in different ways. For example, in the above-mentioned Strasbaugh 6SP, conditioning sub-assembly 118 may be fixedly attached to conditioning arm 114, as shown in FIG. 2A, and during pad conditioning, conditioning sub-assembly 118 moves in a radial direction of polishing pad 100 along with conditioning arm 114. As another example, in Avanti 472, mentioned above, conditioning sub-assembly 118 is fitted to arm 114 such that sub-assembly 118 slides along the length of a stationary conditioning arm 114 in a radial direction of the polishing pad during conditioning.

Conditioning sub-assembly 118 includes an end effector 112 having a substantially planar contact surface 128, attached to which is a conditioning disk 106. Those skilled in the art will recognize that typically a lip portion (not shown to simplify illustration) is fitted to end effector 112, which lip portion enables substantially planar contact surface 128 to attach to conditioning disk 106. A conditioning surface 126 of conditioning disk 106 includes a predetermined non-planar region 104 having abrasive particles 110 and a substantially planar region 108 having blades 120 extending on it. As shown in FIG. 2A, predetermined non-planar region 104 is a concave region sufficiently recessing inwardly into conditioning surface 126 so that, during pad conditioning, conditioning surface 126 substantially conforms to the shape of protruding dome shaped area 102 of polishing pad 100.

According to the present invention, after the degree or profile of protrusion of dome shaped wafer track region 102 to produce the desired center fast polishing conditions is established, the shape and dimensions of the concave region in conditioning surface 126 may be determined so that conditioning surface substantially conforms to at least a portion of dome shaped wafer track region 102. By way of example, for a polishing pad that is about 50 mils thick, the maximum distance of protrusion of the dome shaped wafer track region 102 to produce the desired center fast polishing conditions is generally between about 2 and about 20 mils, preferably between about 2 and about 10 mils and more preferably between about 2 and about 7 mils. Accordingly, the maximum distance of recession of non-planar concave region 104 into conditioning surface 126 is generally between about 2 and about 20 mils, preferably between about 2 and about 10 mils and more preferably between about 2 and about 7 mils. Those skilled in the art will recognize that the radius of curvature of the protruding dome shaped wafer track region may similarly dictate the radius of curvature of the recessed non-planar concave region.

Figure 2B:
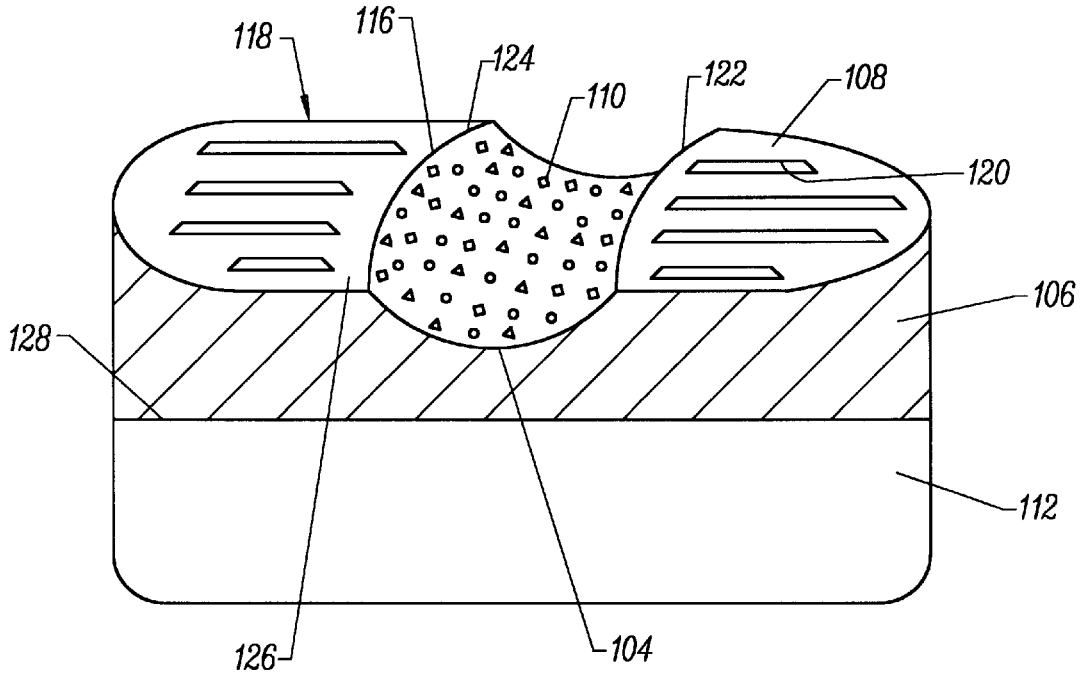
FIG. 2B shows a bottom perspective view of a conditioning surface of the conditioning disk of FIG. 2A that contacts the polishing pad during pad conditioning.

For further illustration, FIG. 2B shows a bottom perspective view of conditioning surface 126 of inverted conditioning sub-assembly 118, including end effector 112 disposed below conditioning disk 106. In FIG. 2B, non-planar region 104, substantially planar region 108, blades 120 and abrasive particles 110 are in substantially the same configuration as shown in FIG. 2A. FIG. 2B, however, clearly shows non-planar region 104 extending across substantially planar region 108 and having a curved profile 116 defined by an inner boundary 122 and an outer boundary 124. The radius of curvature of inner and outer boundaries 122 and 124 of non-planar concave region 104 may be predetermined, like the degree of recession in non-planar concave region 104, such that the conditioning surface 126, during pad conditioning, conforms to and thereby maintains the circular shape of wafer track region 102.

The radius of curvature of inner and outer boundaries 122 and 124 depends on the size of the circular wafer track region 102, which depends typically on the size of the wafer being polished, e.g., a wafer diameter of about 6, 8 or 12 inches, and positioning of the wafer relative to the center of the polishing pad during CMP. For wafer diameters that are between about 6 and about 12 inches, the radius of curvature of the outer boundary of non-planar concave region 104 may generally be between about 7 and about 13 inches.

The distance separating inner and outer boundaries 122 and 124 typically depends on the diameter of the wafer being polished and the extent of wafer displacement due to oscillations during CMP. For wafer diameters that are between about 6 and about 12 inches, the distance between inner and outer boundaries 122 and 124 may generally be between about 0.5 and about 11 inches.

In the embodiment of FIG. 2A, end effector 112 and conditioning disk 106 may be made from a rigid material, such as stainless steel. The size of end effector 112 and conditioning disk 106 may be large enough to include the non-planar concave region described above. Those skilled in the art will, therefore, recognize that the diameter of the cylindrically shaped conditioning disk and end effector, like the dimensions of non-planar concave regions 104, may be dictated by the diameter of the wafer that is subjected to CMP. For the range of concave region dimensions mentioned above that account for different wafer diameters, diameters of end effector 112 and conditioning disk 106 may be between about 10 and about 16 inches. Furthermore, a thickness of between about 0.1 and about 0.25 inches for the conditioning disk has been found to work well.

Abrasive particles 110 may be made from any suitable abrasive materials, e.g., diamond particles, silicon carbide, etc., well known to those skilled in the art. For pad conditioning in oxide CMP (which refers to CMP of a silicon dioxide layer on a wafer surface), abrasive particles 110 preferably include diamond particles. Abrasive particles 110 may be secured on the surface of the conditioning disk in many ways. In one embodiment, abrasive particles 110 of the present invention are fabricated directly on a surface of the conditioning disk using conventional techniques well known to those skilled in the art. By way of example, abrasive particles 110 may be initially embedded on or fixed to conditioning surface 126, e.g., non-planar concave region 104 of FIG. 2B, and then conditioning surface 126 including abrasive particles 110 undergoes nickel plating to effectively secure the abrasive particles to the conditioning surface.

In another embodiment, abrasive particles 110 may be fabricated directly on one side of a strip using techniques well known to those skilled in the art and the other side of the strip adheres to conditioning surface 126 via an adhesive material, such as glue or epoxy. In yet another embodiment, abrasive particles 110 may be secured on conditioning surface 126 of the present invention by a diamond embedded tape that may commercially be available from Marshall Laboratories of Marshall, Minn.

Blades 120 extending on substantially planar region 108 of conditioning surface 126 are made from conventional material well known to those skilled in the art and they are sufficiently sharp to effectively scive at least a portion of the polishing pad during pad conditioning. Blades 120 may be firmly secured to conditioning surface 126 by techniques well known to those skilled in the art.

It is important to note that the shapes of end effector 112 and conditioning disk 106 are not limited to the cylindrical shapes shown in FIGS. 2A and 2B and according to the present invention, the end effector and conditioning disk may be of any suitable shape that includes an appropriate predetermined non-planar region in the conditioning surface.

Figure 2C:
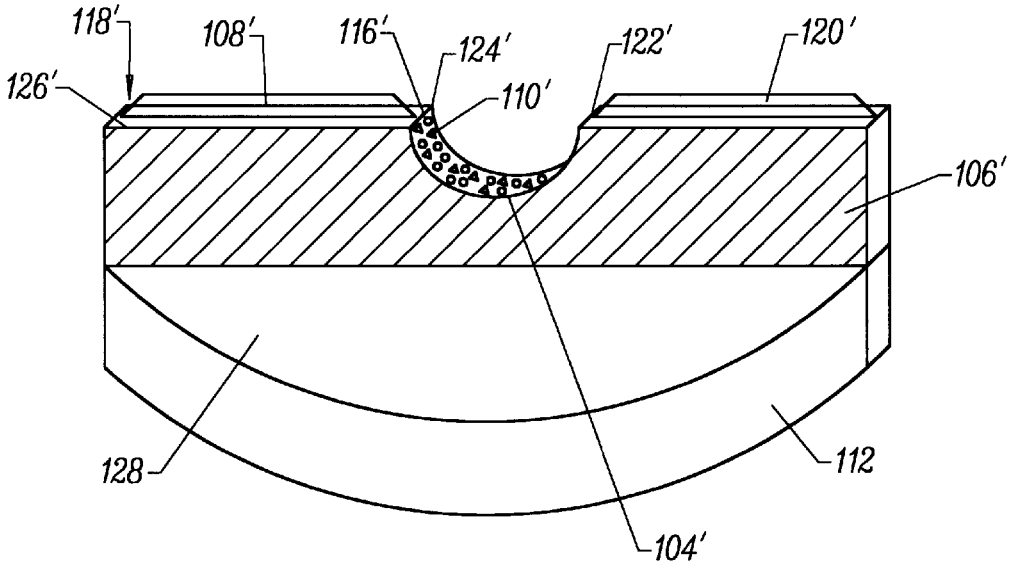
FIG. 2C shows a top perspective view of another conditioning surface of another conditioning sub-assembly, according to an alternative embodiment of the present invention, and the sub-assembly includes a substantially rectangular shaped conditioning body attached to a substantially planar contact surface of an end effector and having a conditioning surface with a concave region that substantially conforms to the circular protruding dome shaped wafer track shown in FIG. 1B.

By way of example, the conditioning disk may be replaced by a substantially rectangular shaped body (not a circular shaped body as in FIG. 2B) that includes a non-planar concave region in the conditioning surface. FIG. 2C shows such a conditioning body integrated into another conditioning sub-assembly 118', according to an alternative embodiment of the present invention. In this embodiment, end effector 112 is attached to a conditioning body 106', which is a narrow rectangular block, e.g., a width is between about 0.25 and about 2 inch, having a non-planar concave region 104' in conditioning surface 126'. In this embodiment, concave region 104' including an inner boundary 122' and an outer boundary 124', a substantially planar region 108', blades 120' and abrasive particles 110' are in substantially the same configuration as their counterparts shown in FIG. 2A. Although the radius of curvature of a curved profile 116' of FIG. 2C is substantially the same as radius of curvature of curved profile 116 of FIG. 2B, the curvature of curved profile 116' appears less exaggerated than the curvature of curved profile 116 because conditioning body 106' of FIG. 2C is narrower than conditioning disk 106 of FIG. 2B.

In another embodiment of the present invention, the predetermined non-planar concave region in the conditioning surface may be formed by integrating an end effector having a contact surface that includes a predetermined non-planar concave region and the contact surface also attaches to a conditioning disk of substantially uniform thickness. In this configuration, a surface of the conditioning disk, which is opposite to the conditioning surface, conformally adheres to the contact surface of the end effector. The resulting conditioning surface, on the opposite side of the conditioning disk, conforms to the shape of the protruding dome shaped wafer track. In this embodiment, the non-planar concave region of the end effector is substantially similar in shape to non-planar concave region 104 of conditioning disk 106 in FIG. 2B. The abrasive particles and blades are also preferably positioned as mentioned above, that is the abrasive particles are positioned on the resulting non-planar concave region of the conditioning surface and the blades are positioned on the substantially planar region of the conditioning surface. The dimensions of the non-planar concave region of the end effector are not, however, the same as that of the conditioning disk in FIG. 2B. Those skilled in the art will recognize that in order for the resulting conditioning surface to have the non-planar concave region conforming to the protruding dome shaped wafer track, the dimensions of the non-planar region of the end effector may account for the thickness of the conditioning disk. In other words, the non-planar concave region in the contact surface of the end effector may recess into the contact surface to a greater degree than the non-planar concave region in the conditioning surface of the conditioning disk, as shown in the embodiment of FIG. 2B.

The non-planar regions formed in the conditioning surface, according to the present invention, may include other shapes besides the concave region described above. In other embodiments, the non-planar region on the conditioning surface of the present invention may include at least two substantially planar regions, one of which protrudes outwardly relative to the other and from the conditioning surface. By way of example, FIG. 3 shows another conditioning subassembly 218 connected to a condition arm 214 and having such substantially planar regions in a conditioning surface. Conditioning sub-assembly 218 includes an end effector 212 including a predetermined non-planar region on a contact surface 228, attached to which is a conditioning disk 206 of substantially uniform thickness and having a conditioning surface 226.

The predetermined non-planar region in contact surface 228 in this embodiment includes one substantially planar region 208 (hereinafter referred to as "protruding planar region 208") protrudes outwardly relative to a second substantially planar region 204 and from conditioning surface 226. Planar region 204 includes abrasive particles 210 positioned throughout the region and second substantially planar region 208 includes blades 220 extending on it.

It should be noted that a non-planar region in the conditioning surface 226, in this embodiment, results because conditioning disk 206 of substantially uniform thickness conformally adheres to the non-planar shape of contact surface 228. Those skilled in the art may recognize that such a conditioning surface may also result if a conditioning disk with a non-planar region is attached to a substantially planar contact surface 228. By way of example, FIG. 3B shows a conditioning sub-assembly 218', as a variation of the embodiment shown in FIG. 3A, attached to conditioning arm 214. Conditioning sub-assembly 218' includes an end effector 212' having a substantially planar contact surface 228', attached to which is a conditioning disk 206' having a non-planar conditioning surface 226'. Conditioning surface 226' includes a protruding planar region 208' that protrudes relative to a second substantially planar region 204'. Planar region 204' includes abrasive particles 210' positioned throughout the region and substantially planar region 208' has blades 220' extending on it.

Figure 3A:
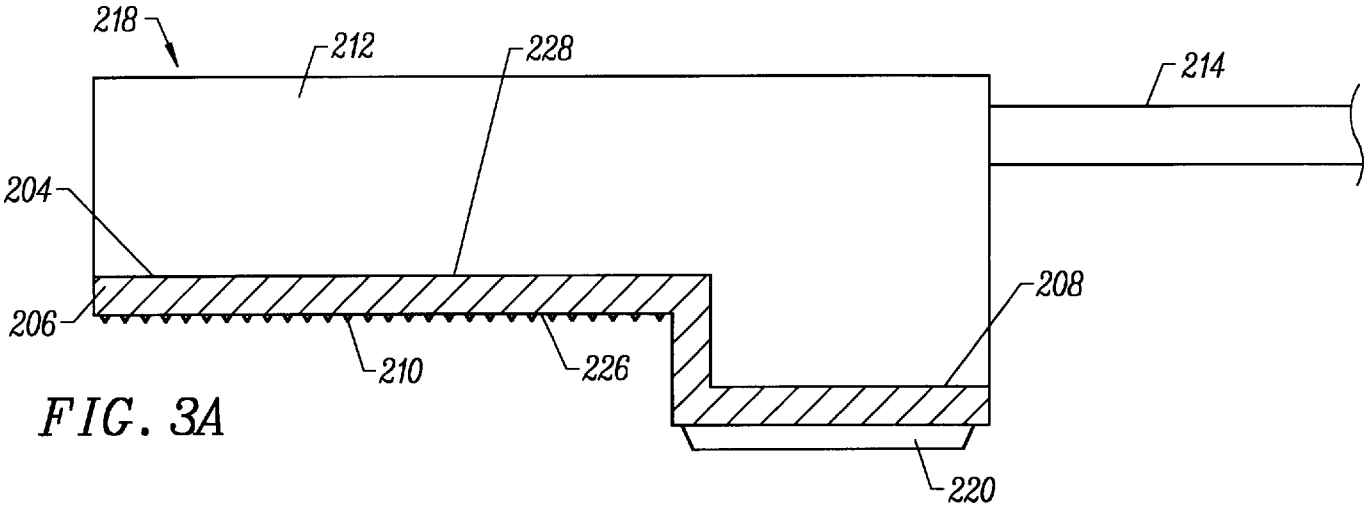
FIG. 3A shows a conditioning sub-assembly, according to another alternative embodiment of the present invention, including an end effector with a non-planar contact surface, which is attached to a conditioning disk of substantially uniform thickness.
Figure 3B:
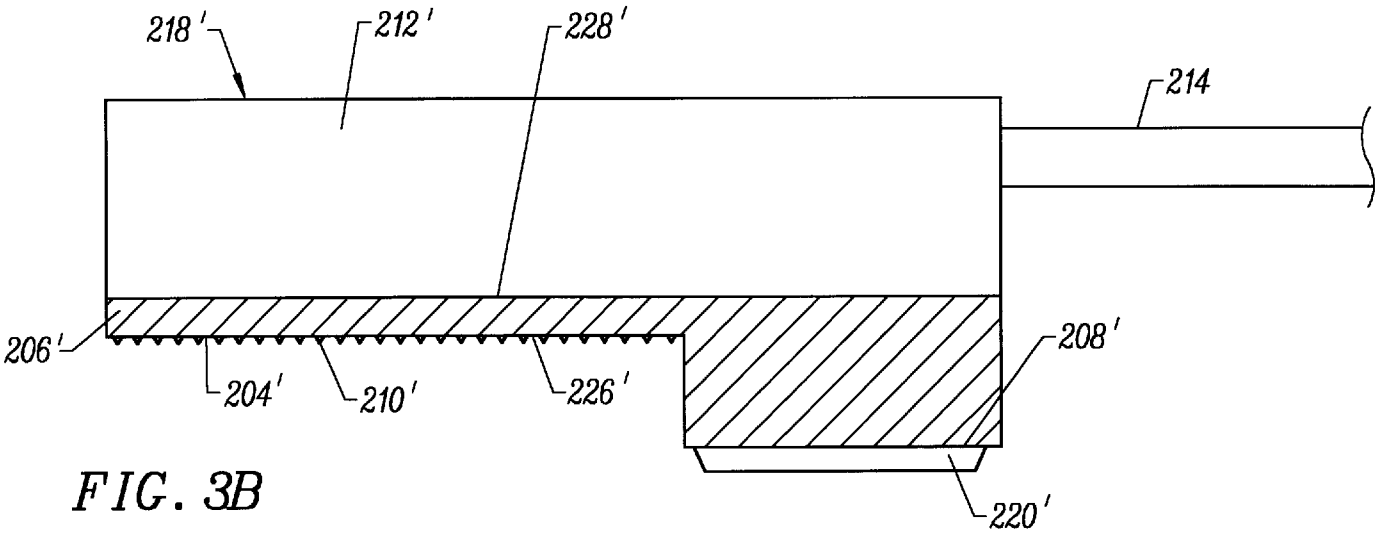
FIG. 3B shows a conditioning sub-assembly, according to yet another alternative embodiment of the present invention, including an end effector having a substantially planar contact surface, which is attached to a conditioning disk with a non-planar conditioning surface.

In the embodiments of FIGS. 3A and 3B described above, protruding planar regions 208 and 208', not necessarily, but preferably are shorter in length than substantially planar regions 204 and 204', respectively. For polishing pads ranging from between about 10 inches to about 22.5 inches, protruding planar regions 208 and 208' may generally be between about 0.5 inches and about 5 inches and substantially planar regions 204 and 204' may be between about 0.5 inches and about 20 inches. In another embodiment of FIGS. 3A and 3B, conditioning surfaces 226 and 226' may include a second protruding planar region positioned a certain distance, e.g., between about 4 and about 10 inches, away from protruding planar regions 204 and 204' such that during pad conditioning a polishing pad having a substantially planar surface may be shaped to have a protruding region similar to a circular protruding wafer track, except this protruding region has edges that sharply rise from the polishing pad surface as opposed to rising gradually from the polishing pad surface in the dome shaped wafer track. Such a protruding surface also produces the desired center fast polishing conditions during wafer CMP.

Those skilled in the art will recognize that in embodiments of FIGS. 3A and 3B, components such as end effectors, conditioning disks, abrasive particles, and blades may be made from similar materials and assembled as described in the embodiments of FIGS. 2B and 2C. Furthermore, the shape of conditioning disks 206 and 206' and end effectors 212 and 212' may be of any suitable shape, e.g., including those described above in the embodiments of FIGS. 2B and 2C. In one preferred embodiment, however, the conditioning disks of FIG. 3A and 3B are narrow substantially rectangular block shaped rigid bodies. Furthermore, those skilled in the art will recognize that the protruding planar regions of FIGS. 3A and 3B may have a curved profile similar to the curved profile of the concave regions of FIGS. 2B. As explained above, such curved profiles help maintain or carve out a circular wafer track during pad conditioning. The degree of protrusion in the protruding planar regions relative to substantially planar region in FIGS. 3A and 3B is also approximately the same as the degree of recession of the concave region in FIGS. 2B and 2C.

A pad conditioning process, according to one embodiment of the present invention, includes employing the conditioning sub-assemblies of FIGS. 2A, 2B, 2C, 3A and 3B. The pad conditioning process begins when the conditioning sub-assembly is lowered on a rotating polishing pad. By way of example, as shown in FIG. 2A, conditioning sub-assembly 118 is lowered to contact polishing pad 100. Although it is not necessary, but in one embodiment, the conditioning disk and the end effector of the present invention also rotate together.

A sufficient down force is then applied, on the conditioning sub-assembly such that the abrasive surface of the conditioning disk engages the polishing pad. In one embodiment of the present invention, the down force is applied by a pneumatic cylinder, which is connected to the conditioning sub-assembly under operation. For a polishing pad that is made of at least one material selected from the group consisting of urethane, polyurethane, felt polymer and a filler material, the down force may generally be between about 1–15 pounds (lbs), preferably be between about 1–10 pounds (lbs) and more preferably be between about 1.5 and 7 lbs.

Abrasive particles, e.g., 110, 110', 210, and 211 of FIG. 2B, 2C, 3A and 3B, engage with the polishing pad to form microgrooves thereon. As mentioned before, microgrooves may facilitate slurry flow across the polishing pad and to the pad-wafer interface and thereby enhance the polishing rate of a wafer layer. The conditioning sub-assembly under sufficient down force also causes blades, e.g., 120, 120', 220 and 220' of FIGS. 2B, 2C, 3A and 3B, to scive the polishing pad.

In other words, the blades literally cut into and remove at least a portion of the polishing pad when the blades, under sufficient down force, engage the polishing pad. Thus, in this manner the conditioning assemblies of the present invention, during pad conditioning, are adapted to maintain the existing shape of the polishing pad and/or shape a polishing pad having a substantially planar surface. Of course once a polishing pad has been shaped by the conditioning sub-assembly of the present invention, such shape of the polishing pad may be maintained by the same conditioning sub-assembly.

It is, however, preferable to employ conditioning sub-assemblies 118 and 118' as shown in FIGS. 2B and 2C to maintain the shape of the polishing pad. By way of example, if the polishing pad of FIG. 1A undergoes conditioning, conditioning sub-assemblies shown in FIG. 2B and 2C may be employed to effectively maintain the shape of the protruding dome shaped wafer track region 102, as shown in FIG. 2A.

In another preferred embodiment, conditioning sub-assemblies 218 and 218' of FIGS. 3A and 3B may be employed to shape a substantially planar surface on a polishing pad. By way of example, after several wafers have been polished on a particular polishing pad having a substantially planar surface and the worn-out polishing pad produces center slow conditions as explained above, condition sub-assemblies 218 and 218' of FIG. 3A and 3B may be employed during pad conditioning to effectively shape the polishing pad to produce center fast conditions, as explained hereinafter.

Figure 4:
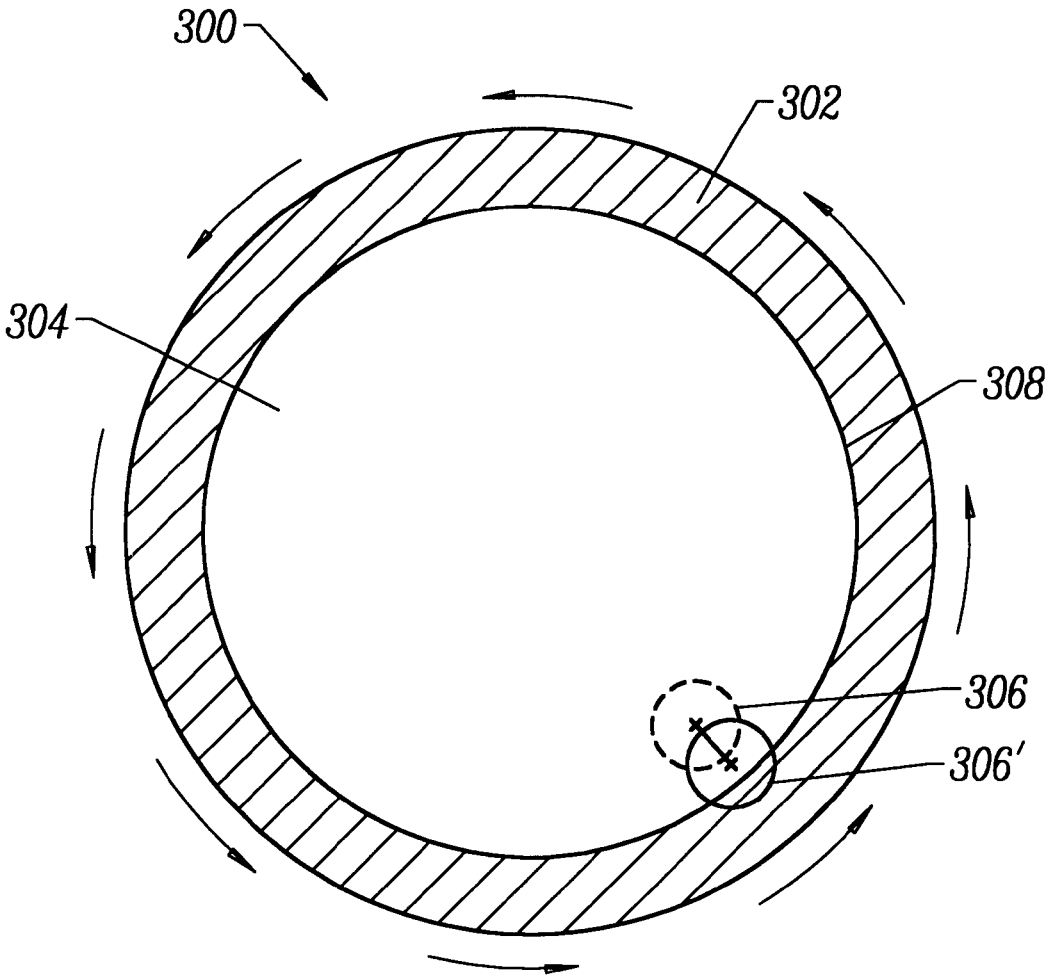
FIG. 4 shows a top view of a wafer undergoing CMP under center fast polishing conditions on a polishing pad, which is shaped during pad conditioning by the conditioning sub-assemblies of FIGS. 3A or 3B.

FIG. 4 shows a polishing pad 300 shaped by pad-conditioning sub-assemblies 218 and 218' of FIGS. 3A and 3B during pad conditioning. Under sufficient down force, blades positioned on protruding planar regions 208 and 208' penetrate and scive the polishing pad of substantially uniform thickness during pad conditioning. Consequently, an area near the periphery of the polishing pad surface that contacts the protruding planar regions of FIGS. 3A and 3B is removed to form one substantially planar recessed area 302, which recesses inwardly into the polishing pad surface and also recesses relative to a substantially planar protruding area 304 formed towards a center area of the polishing pad. A circular lip region 308 on the polishing pad marks a boundary of a protruding planar area disposed towards the center area of the pad and beyond this boundary a recessed area is formed near the periphery of the polishing pad surface.

During CMP of a rotating and oscillating wafer 306 on polishing pad 300, a part of the peripheral portion of wafer 306 goes over lip region 308 and acquires a position shown by wafer 306'. In this position, a part of the peripheral portion of wafer 306' does not contact the polishing pad and as a result, this part does not get polished. Thus, over a period of time, the film removal rate at the peripheral region of the wafer is slower than at a center region of the wafer giving rise to the desired center fast polishing conditions.

Those skilled in the art will, therefore, appreciate that after several wafers have been polished on a substantially planar polishing pad surface and the worn-out polishing pad surface begins to exhibit center slow polishing conditions, conditioning sub-assemblies 218 and 218' of FIGS. 3A and 3B may be employed to shape the polishing pad as described above to produce center fast polishing conditions.

The present invention represents a marked improvement over the conventional pad conditioning processes. By way of example, pad conditioning according to the present invention effectively maintains an existing polishing pad shape and/or shapes a polishing pad having a substantially planar surface to have center fast polishing conditions. As mentioned before, maintaining or producing center fast polishing conditions is a viable approach to promote uniform polishing rate as the end of a production lot draws near and thereby prolongs the polishing pad life. This considerably lowers the replacement cost of polishing pads in a substrate fabrication facility.

As another example, the predetermined non-planar regions in a conditioning surface of the conditioning sub-assemblies of the present invention eliminate the need for complicated, time-consuming conditioning recipes and segmented movement of the end effector that are not effective in controlling and maintaining the shape of the polishing pad. This also translates into a higher throughput for the wafer CMP process. Pad conditioning, according to the present invention, requires that relatively minor modifications be made to the conventional pad conditioning sub-assemblies. By way of example, by merely replacing the conventional end effector or conditioning disk with an end effector or conditioning disk of the present invention, all the benefits of the present invention can be realized.

As yet another example, because the non-planar shape of conditioning surface, in the conditioning sub-assemblies of the present invention, can be predetermined to conform to the shape of the polishing pad, it is easy to maintain the polishing pad shape during pad conditioning, regardless of whether the hardness of the pads employed varies from one pad lot to another.

Although the foregoing invention has been described in some detail for purposes of clarity of understanding, it will be apparent that certain changes and modifications may be practiced within the scope of the appended claims. For example, while the specification has described the pad conditioning processes and apparatuses to be used in the context of center fast polishing, there is no reason why in principle the end effector and conditioning disk could have a predetermined shape such that the polishing pad shape promotes center slow polishing or other polishing conditions that contribute to uniform film removal rates. Therefore, the present embodiments are to be considered as illustrative and not restrictive, and the invention is not to be limited to the details given herein, but may be modified within the scope of the appended claims.

What is claimed is:

1. An end effector to facilitate conditioning of a surface of a polishing pad used in chemical-mechanical polishing of an substrate surface, said end effector comprises a rigid body including a contact surface capable of being attached to a conditioning disk and having in a substantially planar region of the contact surface a concave region recessed inwardly into the contact surface of the end effector and extending across said substantially planar region in a curved profile defined by an inner boundary and outer boundary of said concave region such that shape of said concave region is adapted to at least one of (i) facilitate in maintaining a circular protruding dome shaped area on the polishing pad and (ii) shape said polishing pad, when said end effector is employed to condition said polishing pad.

2. A process of conditioning a polishing pad used in chemical-mechanical polishing of an substrate, comprising:

providing a conditioning sub-assembly including:

an end effector having a substantially planar contact surface that is adapted to attach to a conditioning disk, and a conditioning disk for effectively conditioning a polishing pad used in chemical-mechanical polishing of a substrate surface, said conditioning disk comprises a rigid body of non-uniform thickness including a conditioning surface having an abrasive surface on a predetermined non-planar region that is adapted to at least one of (i) effectively maintain a non-planar area on said surface of said polishing pad and (ii) shape a polishing pad when said conditioning disk is employed to condition said polishing pad, said conditioning disk includes another surface that adheres to the substantially planar contact surface of the end effector; and applying a down force on said conditioning sub-assembly such that said abrasive means of said conditioning disk engages a surface of said polishing pad and said conditioning sub-assembly at least one of effectively maintains a non-planar area on said surface of said polishing pad by conformally positioning said predetermined non-planar conditioning region on said non-planar area of said polishing pad and shapes said polishing pad to include a non-planar area by sciving a portion of the polishing pad.

3. A conditioning sub-assembly, comprising:

an end effector to facilitate conditioning of a surface of a polishing pad used in chemical-mechanical polishing of a substrate surface, said end effector comprises a rigid body including a contact surface capable of being attached to a conditioning disk and having in a substantially planar region of the contact surface a concave region recessed inwardly into the contact surface of the end effector and extending across said substantially planar region in a curved profile defined by an inner boundary and outer boundary of said concave region such that shape of said concave region is adapted to at least one of (i) facilitate in maintaining a circular protruding dome shaped area on the polishing pad and (ii) shape said polishing pad, when said end effector is employed to condition said polishing pad; and a conditioning disk including a conditioning surface having abrasive means adapted to engage the polishing pad and a second surface adhering to the contact surface of the end effector and thereby shaping said conditioning surface of the conditioning disk to include in a substantially planar conditioning region a concave conditioning region that almost conforms to a portion of the circular protruding dome shaped area on the polishing pad during conditioning of the polishing pad.

4. The conditioning sub-assembly of claim 3, wherein the abrasive means is a tape adhering to at least a concave conditioning region of the conditioning surface on one side and impregnated with abrasive particles on a second side, said abrasive particles engage the protruding dome shaped area of the polishing pad during conditioning of the polishing pad to form microgrooves thereon.

5. The conditioning sub-assembly of claim 3, wherein the abrasive means includes blades disposed at least on a substantially planar conditioning region of the conditioning surface, the substantially planar conditioning region excludes the concave conditioning region of the conditioning surface and said blades adapted to scive the polishing pad and thereby effectively erode at least a portion of the polishing pad around the protruding dome shaped area.

6. The end effector of claim 1, wherein the inner boundary and outer boundary of the concave region are separated by a distance that is between about 6 inches and about 14 inches.

7. The end effector of claim 1, wherein the outer boundary of the concave region has a radius of curvature that is between about 7 and about 13 inches.

8. The end effector of claim 1, wherein the concave region recesses inwardly into the contact surface of the end effector by a maximum distance of between about 2 and about 20 mils.

9. The conditioning sub-assembly of claim 3, wherein said conditioning disk has a predetermined uniform thickness that is between about 0.1 and about 0.25 inches.

10. An end effector to facilitate conditioning of a surface of a polishing pad used in chemical-mechanical polishing of an substrate surface, said end effector comprises a rigid body including a contact surface capable of being attached to a conditioning disk and said contact surface including a first substantially planar portion that protrudes outwardly, relative to a second substantially planar portion, from the contact surface and the contact surface is adapted to at least one of facilitate in maintaining and forming on the polishing pad one substantially planar area that recesses inwardly, relative to a second substantially planar area, into the polishing pad surface, when said end effector is employed to condition said polishing pad.

11. A conditioning sub-assembly, comprising:

an end effector to facilitate conditioning of a surface of a polishing pad used in chemical-mechanical polishing of an substrate surface, said end effector comprises a rigid body including a contact surface capable of being attached to a conditioning disk and said contact surface including a first substantially planar portion that protrudes outwardly, relative to a second substantially planar portion, from the contact surface and the contact surface is adapted to at least one of facilitate in maintaining and forming on the polishing pad one substantially planar area that recesses inwardly, relative to a second substantially planar area, into the polishing pad surface, when said end effector is employed to condition said polishing pad; and a conditioning disk including a conditioning surface having abrasive means adapted to engage the polishing pad and a second surface adhering to the contact surface of the end effector and thereby shaping said conditioning surface of the conditioning disk to include a first substantially planar conditioning region that protrudes outwardly relative to a second substantially planar conditioning region and from the conditioning surface such that during conditioning of the polishing pad the conditioning surface effectively forms one substantially planar area that recesses inwardly relative to a second substantially planar area and into the polishing pad surface.

12. The conditioning sub-assembly of claim 11, wherein said abrasive means is a tape adhering to a second substantially planar conditioning region of the conditioning surface on one side and impregnated with abrasive particles on a second side, said abrasive particles engage the second substantially planar area of the polishing pad during conditioning of the polishing pad to form microgrooves thereon.

13. The conditioning sub-assembly of claim 11, wherein the abrasive means includes blades disposed on at least the first substantially planar conditioning region of the conditioning surface and said blades effectively scive the polishing pad surface during conditioning of the polishing pad to effectively erode at least a portion of the of the polishing pad surface and form thereon the first substantially planar area adjacent to a second substantially planar area.

14. The end effector of claim 10, wherein the second substantially planar portion has a length that is between about 0.5 inches and about 20 inches.

15. The end effector of claim 10, wherein the first substantially planar portion has a length that is between about 0.5 inches and about 5 inches.

16. The end effector of claim 10, further includes a third substantially planar portion that protrudes from the contact surface more than the second substantially planar portion and nearly to same extent as the first substantially planar portion.

17. The end effector of claim 10, wherein a distance between the third and first substantially planar portions is between about 0.5 and about 11 inches.

18. The end effector of claim 10, wherein the first substantially planar portion protrudes relative to second planar portion by a distance of between about 2 and about 20 mils.

19. The end effector of claim 18, wherein the first substantially planar portion protrudes relative to second planar portion by a distance of between about 2 and 10 mils.

20. A conditioning disk capable of attaching to a contact surface of an end effector for effectively conditioning a polishing pad used in chemical-mechanical polishing of a substrate surface, said conditioning disk directly engages said polishing pad during conditioning, but said end effector does not engage said polishing pad during conditioning, said conditioning disk comprises a rigid body of non-uniform thickness including a conditioning surface having a predetermined non-planar region that is adapted to at least one of (i) effectively maintain a non-planar area on said surface of said polishing pad and (ii) shape a polishing pad when said conditioning disk is employed to condition said polishing pad.

21. The conditioning disk of claim 20, wherein the predetermined non-planar region of the conditioning disk includes in a substantially planar region of the conditioning surface a concave region recessed inwardly into the conditioning surface of the conditioning disk and extending across said substantially planar region in a curved profile defined by an inner boundary and outer boundary of said concave region such that shape of said concave region almost conforms to at least a portion of and maintains the circular protruding dome shaped area on the polishing pad when the conditioning disk is employed to condition the polishing pad.

22. A conditioning sub-assembly, comprising:

an end effector having a substantially planar contact surface that is adapted to attach to a conditioning disk, and said conditioning disk for effectively conditioning a polishing pad used in chemical-mechanical polishing of a substrate surface, said conditioning disk comprises a rigid body of non-uniform thickness including a conditioning surface having abrasive means adapted to engage the polishing pad on a predetermined non-planar region that is adapted to at least one of (i) effectively maintain a non-planar area on said surface of said polishing pad and (ii) shape a polishing pad when said conditioning disk is employed to condition said polishing pad, said conditioning disk includes another surface adhering to the substantially planar contact surface of the end effector.

23. The conditioning assembly of claim 22, wherein the predetermined non-planar region of the conditioning disk includes in a substantially planar region of the conditioning surface a concave region recessed inwardly into the conditioning surface of the conditioning disk and extending across said substantially planar region in a curved profile defined by an inner boundary and outer boundary of said concave region such that shape of said concave region almost conforms to at least a portion of and maintains the circular protruding dome shaped area on the polishing pad when the conditioning disk is employed to condition the polishing pad.

24. The conditioning sub-assembly of claim 22, wherein said abrasive means is a tape adhering to at least the concave region of said conditioning surface of said conditioning disk on one side and impregnated with abrasive particles on a second side, said abrasive particles engage the protruding dome shaped area of the polishing pad during conditioning of the polishing pad to form microgrooves thereon.

25. The conditioning sub-assembly of claim 22, wherein the abrasive means includes blades disposed at least on the substantially planar region of the conditioning surface of the conditioning disk, the substantially planar region excludes the concave region of the conditioning disk and said blades adapted to scive the polishing pad during the conditioning of the polishing pad and thereby effectively erode at least a portion of the polishing pad around the protruding dome shaped area.

26. The conditioning disk of claim 20, wherein the predetermined non-planar region of said conditioning surface of the conditioning disk includes a first substantially planar portion that protrudes outwardly relative to a second substantially planar portion from the conditioning surface and during conditioning of the polishing pad the conditioning surface effectively forms one substantially planar area that recesses inwardly relative to a second substantially planar area into the polishing pad surface.

27. The conditioning assembly of claim 22, wherein the predetermined non-planar region of said conditioning surface of the conditioning disk includes a first substantially planar portion that protrudes outwardly relative to a second substantially planar portion from the conditioning surface and during conditioning of the polishing pad the conditioning surface effectively forms one substantially planar area that recesses inwardly relative to a second substantially planar area into the polishing pad surface.

28. The process of claim 23, wherein in said applying the down force is between about 1 and about 15 pounds.

29. A process of conditioning a polishing pad used in chemical-mechanical polishing of an substrate, comprising:

providing a conditioning sub-assembly including:

an end effector including a rigid body having a contact surface with a predetermined non-planar region and capable of being attached to a conditioning disk, said predetermined non-planar region includes in a substantially planar region of the contact surface a concave region recessed inwardly into the contact surface of the end effector and extending across said substantially planar region in a curved profile defined by an inner boundary and outer boundary of said concave region; and a conditioning disk including a conditioning surface having abrasive means adapted to engage the polishing pad and said conditioning disk further including another surface adhering to the contact surface of the end effector and thereby shaping the conditioning surface to have in a substantially planar conditioning region a predetermined non-planar conditioning region;

rotating said polishing pad; and applying a down force on said conditioning sub-assembly such that said abrasive means of said conditioning disk engages the surface of said polishing pad and said conditioning sub-assembly at least one of (i) effectively maintains a non-planar area on said surface of said polishing pad by conformally positioning said predetermined non-planar conditioning region on said non-planar area of said polishing pad and (ii) shapes said polishing pad to include a non-planar area by sciving a portion of the polishing pad.

30. The process of claim 29, wherein in said applying the down force is between about 1 and about 15 pounds.

31. The process of claim 30, wherein the down force is between about 1 and about 10 pounds.

32. The process of claim 31, wherein the down force is between about 1.5 and about 7 pounds.

* * * * *